United States Patent [19]

Fieschi

[11] Patent Number: 4,829,919

[45] Date of Patent: May 16, 1989

[54] DEVICE TO FEED RIBBON-LIKE TRIMMINGS UNDER THE PRESSURE FOOT OF A SEWING MACHINE

[75] Inventor: Giorgio Fieschi, Milan, Italy

[73] Assignee: Rockwell-Rimoldi S.P.A., Olcella, Italy

[21] Appl. No.: 238,829

[22] Filed: Aug. 31, 1988

[30] Foreign Application Priority Data

May 30, 1988 [IT] Italy ..... 20801 A/88

[51] Int. Cl.[4] ..... D05B 35/10; D05B 27/14

[52] U.S. Cl. ..... 112/152; 112/121.27; 112/303; 112/322; 112/130

[58] Field of Search ..... 112/152, 153, 303, 121.27, 112/121.26, 318, 322, 130

[56] References Cited

U.S. PATENT DOCUMENTS 3,381,639 5/1968 Miller ..... 112/121.27 R
3,664,284 5/1972 Hester ..... 112/152
3,680,509 8/1972 Miller ..... 112/152
4,201,145 5/1980 Blessing ..... 112/318

*Primary Examiner*—H. Hampton Hunter
*Attorney, Agent, or Firm*—Laff, Whitesel, Conte & Saret

[57] ABSTRACT

The device herein described comprises a feed roller 12 rotated by a motor 16 and disposed before the presser foot 9 at right angles to the feed advance direction of the workpiece. Individually and selectively acting against the feed roller 12 are two pressure backing rollers 19, 20 each of which engages a respective piece of ribbon-like trimmings to push it against the feed roller which carries out the pulling thereof. The pressure backing rollers 19, 20 are supported by a swinging plate which is caused to oscillate upon the action of a fluid-operated cylinder 30 in order to make the backing rollers selectively engage with the feed roller 12 and therefore selectively feed said ribbon-like trimmings under the pressure foot 9.

10 Claims, 2 Drawing Sheets

2
15
14
36
36a
11
31
10
21a
25
28
24
1
7
28
22
23
21
25a
12
13
18
24a
20
19
11
10
41
39
8
34
38
37
9
4
10
34a 2
15
14
36
36a
11
10
31
24
1
25
21a
18
28
22
28
21
13
7
23
12
25a
24a
20
19
41
11
10
39
8
40
34a
37
9
11
34
4

DEVICE TO FEED RIBBON-LIKE TRIMMINGS UNDER THE PRESSURE FOOT OF A SEWING MACHINE

BACKGROUND OF THE INVENTION

1. Field of the Invention

The present invention relates to a device to feed ribbon-like trimmings under the presser foot of a sewing machine, of the type comprising at least a support arm fastened to the sewing machine, a feed roller rotatably engaged with the support arm and extending before the presser foot of the sewing machine according to an axis at right angles to the feed advance direction of the workpiece, a motor to rotate the feed roller, at least two guides, each of them extending upwardly from the feed roller and slidably engaging a piece of trimmings to guide it towards the feed roller and pressure means acting in abutment relationship with the feed roller to push one of said trimmings against the feed roller itself so that it may be pulled by said feed roller as a result of the rotational movement imparted thereto.

In greater detail, the present device is adapted to be associated with sewing machines for industrial use to automatically carry out the selective feeding of two different elastic bands or strips or other ribbon-like trimmings.

2. Prior Art

It is known that there are industrial sewing machines which with the aid of appropriate feeding devices are capable of applying an elastic strip or other ribbon-like trimmings (such as tapes, neck-bands and the like) to a workpiece while a line of stitching is being performed.

According to one of said known feeding devices, it is provided the use of a feed roller which, by a support arm fixedly fastened to the sewing machine, is rotatably held up before the presser foot in a slightly raised position with respect to the workpiece-supporting table. In greater detail, the feed roller extends according to an axis at right angles to the advance direction of the workpiece on the supporting table and can be rotated about its own axis upon command of a motor or by other driving gears connected to the actuating members of the sewing machines.

Associated with the feed roller is a pressure backing roller which is elastically urged against the feed roller. The piece of trimmings running along one or more guides extending from the feed roller and backing roller, engages between these rollers and by effect of the rotation imparted to the feed roller, is fed under the presser foot while the stitching is being executed.

Although these devices have been successful in carrying out the application of trimmings to a workpiece, it has been found that their use involves some difficulties when two different types of trimmings have to be selectively fed. This requirement for example occurs in the manufacture of underclothing garments when which elastic strips or bands of two different widths or colors must be inserted.

In these cases the described devices are not very pratical in use. In fact each time it is necessary to replace the trimmings to be applied to the workpiece, the operator must manually disengage the previously used trimmings from the feed roller and pressure backing roller and engage the new trimmings to apply during the execution of the subsequent line of stitching, between said two rollers.

Due to this necessity, above all when mass-produced garments are concerned there are rather long down times and as a result the cost of the finished articles is increased.

SUMMARY OF THE INVENTION

Under this situation, it is an object of the present invention to solve the above drawback by providing a device capable of carrying out the selection of the trimmings to be applied to the workpiece in a completely automatic manner, without needing manual interventions on the part of the operator to accomplish the engagement and disengagement of each piece of trimmings to and from the feed roller and the corresponding pressure backing roller.

The foregoing and further objects which will become more apparent in the course of the present description are substantially attained by a device to feed ribbon-like trimmings under the presser foot of a sewing machine, characterized in that said pressure means comprises a first pressure backing roller and a second pressure backing roller extending parallelly to the axis of the feed roller, each of them being arranged to act on a respective ribbon-like piece of trimmings which is engaged along at least a corresponding guide and is interposed between the feed roller and the respective pressure backing roller and contacts the latter with its side facing the other pressure backing roller, said pressure backing rollers being rotatably supported by a swinging plate oscillatably engaged with the support arm and actuated by switching means to individually and selectively bring said pressure backing rollers in abutment against the feed roller thus causing the pulling of the corresponding piece of trimmings by said feed roller which, on the other hand, is designed to reverse its rotation when upon the action of said switching means there is a change in the pressure backing roller which is brought in abutment against it.

BRIEF DESCRIPTION OF THE DRAWINGS

Further features and advantages will best be understood from the detailed description of a preferred embodiment of a device to feed ribbon-like trimmings under the presser foot of a sewing machine, according to the present invention, given hereinafter by way of non limiting example with reference to the accompanying drawing in which.

DESCRIPTION OF THE PREFERRED EMBODIMENT

Figure 1:
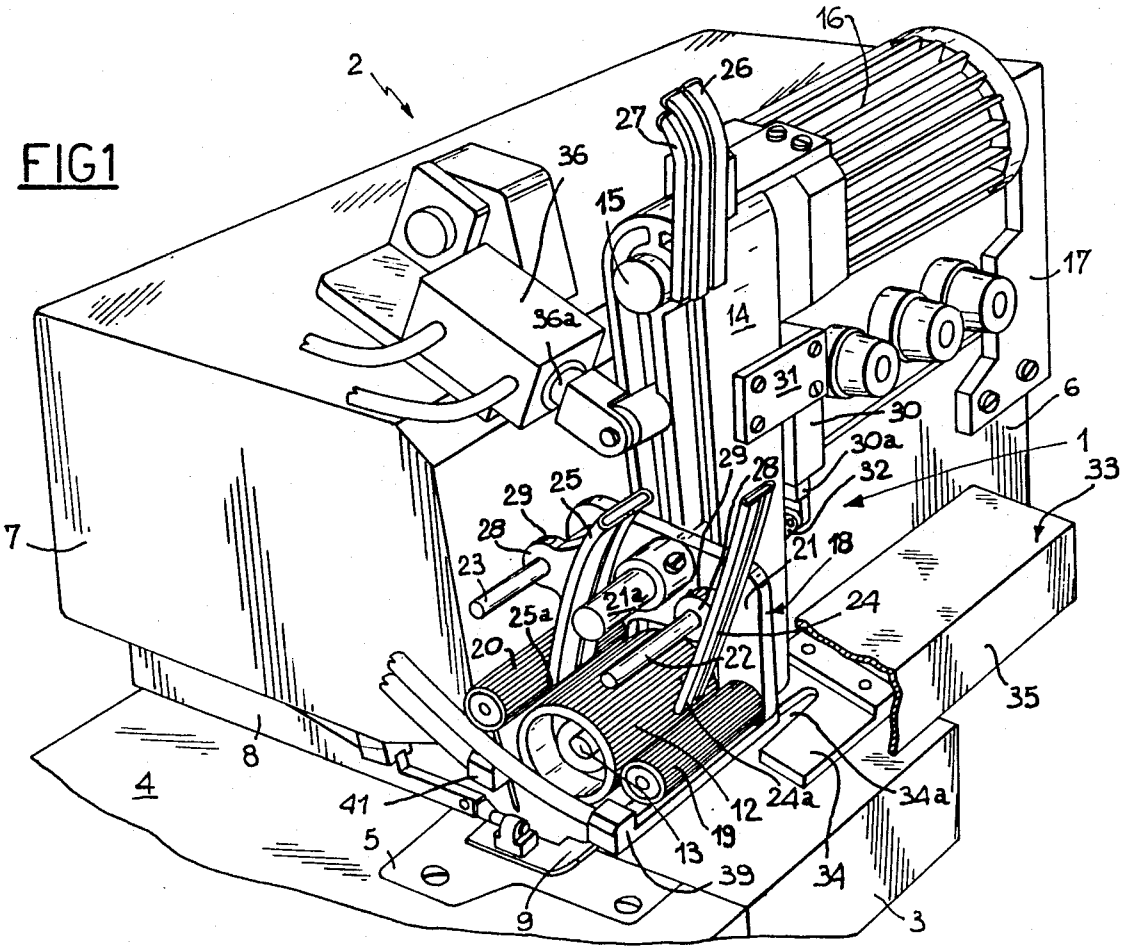
FIG. 1 is a partially broken, perspective view of a sewing machine provided with a device in accordance with the invention.

Referring to the drawings a device adapted to feed trimmings under the presser foot of a sewing machine in accordance with the invention has been globally identified by reference numeral 1.

In the embodiment shown, the device 1 is associated with a conventional sewing machine 2 of the type adapted to perform overedge stitching. In known manner, the sewing machine 1 comprises a bed 3 defining a workpiece-supporting table 4 at the top. A workpiece is caused to move forward on said table during the execution of a line of stitching by means of feed dogs acting in the region of a needle plate 5.

Rising from bed 3 is a standard 6 supporting a head 7 carrying a presser bar 8 at the lower part thereof. Supported at the front of said presser bar 8 is a presser foot 9 acting upon said feed dogs in order to push the workpiece against them.

Said device 1 has the function of individually and selectively feeding first and second ribbon-like pieces of trimmings 10,11 (FIGS. 2 and 3) under the presser foot 9 in order to cause said trimmings to be applied to a workpiece while a line of stitching is being performed.

To this end, the device 1 comprises a feed roller 12 extending in front of the presser foot 9 according to an axis at right angles to the feed advance direction of the workpiece on the supporting table 4 and in a raised position with rispect to the supporting table itself. The feed roller 12 is rotatably engaged by a drive spindle 13 to a support arm 14 which in turn is fastened to the sewing machine 2.

In greater detail the support arm 14 is rotatably passed through by a drive shaft 15 associated with an electric driving motor 15 fixedly fastened to the standard 6 of the sewing machine 2 by means of a support bracket 17. The drive shaft 15 performs two functions, i.e. that of holding up the support arm 14 and that of taking in rotation the feed roller 12 upon command of the driving motor 16 and through a toothed belt not shown or similar gear means.

In an original manner, pressure means 18 is associated with the feed roller 12 and it individually and selectively acts against trimmings 10 and 11 to urge them against the feed roller itself.

In accordance with the present invention pressure means 18 comprises a first pressure backing roller 19 and a second pressure backing roller 20 extending parallelly to the feed roller 12 and rotatably engaged with a swinging plate 21 connected to the support arm 14.

In greater detail, the swinging plate 21 is fixedly engaged to a pivot pin 21a rotatably crossing the support arm 14 so that the plate may angularly oscillate about an axis parallel to the axis of the feed roller 12.

Extending from the swinging plate 21, parallelly to the backing rollers 19, 20 and at a higher position with respect to the latter, are to support rods 22, 23 respectively engaging two guides 24, 25 the lower ends of which 24a, 25a are oriented towards directions respectively passing between the first backing roller 19 and the feed roller 12 and between the second backing roller 20 and the feed roller itself. Said first and second guides 24, 25 are designed to respectively engage the first and the second piece of trimmings 10 and 11, which may come from auxiliary guides 26, 27 located close to the top of the support arm 14 so that each of said trimmings penetrates between the feed roller 12 and the respective pressure backing roller 19, 20 coming in contact with the latter by its side facing the other backing roller.

Preferably each guide 24, 25 is connected to its respective supporting bar 22, 23 by an attachment element 28 slidably engaging along the rod itself and adapted to be fixedly fastened thereto by a screw 29 or other threaded members. So it is possible to dispose said guides in a transverse direction with respect to the feed advance direction of the workpiece on the supporting table 4 so that trimmings 10, 11 may be applied to the workpiece spaced apart a predetermined distance from the workpiece edge.

The present device 1 further comprises switching means acting on the swinging plate 21 to move it angularly in either way about the axis of the pivot pin 21a in order to individually and selectively bring the pressure backing rollers 19, 20 in abutment against the feed roller 12. Preferably, said switching means consists of a first fluid-operated double-acting cylinder 30, fastened to the support arm 14 by means of an attachment plate 31, the rod 30a of which acts on a connecting lever 32 (partially shown in FIG. 1) integral to the pivot pin 21a on its side opposite the swinging plate 21.

Preferably it is also provided the presence of a cutting unit 33, of a known and conventional type, having a cutting member 34 which, upon the action of fluid-operated cylinders not shown, is movable at right angles to the advance direction of the workpiece on the supporting table 4 from a rest condition in which, as shown in FIG. 1, it is moved apart sideways from the supporting table and located in a protection housing 35, to a working condition in which, when one of the trimming 10, 11 has been applied to a workpiece, acts on the applied piece of trimmings to cut it in the portion included between the presser foot 9 and the feed roller 12. In greater detail, when the cutting member 34 moves to its working position, the piece of trimmings 10 or 11 to be cut is engaged in a slit 34a formed in the cutting member and is acted upon by cutting means not shown as known per se.

The present device further comprises positioning means acting in such a manner that each of said trimmings 10, 11, when it is ready to be applied to the workpiece, can maintain a predetermined positioning and orientation in the portion included between the feed roller 12 and the presser foot 9.

Figure 2:
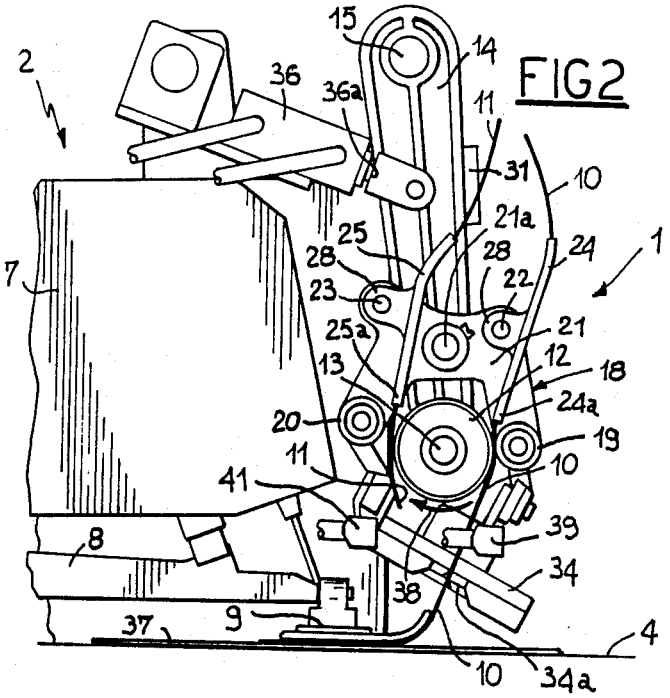
FIG. 2 is a schematic side view showing the device arranged to feed one ribbon-like piece of trimmings under the presser foot of the sewing machine.
Figure 3:
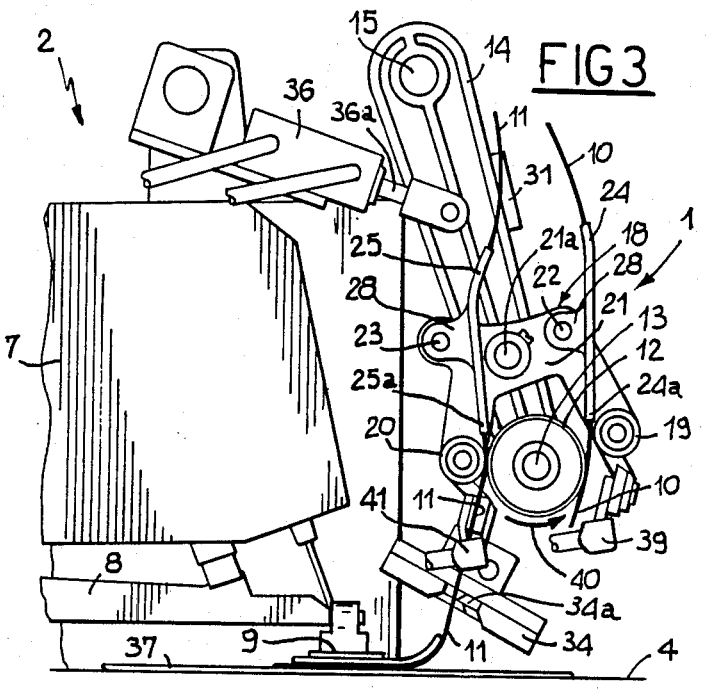
FIG. 3 is a schematic side view of the device arranged to feed a second ribbon-like piece of trimmings under the presser foot.

Preferably said positioning means comprises a second fluid-operated double-acting cylinder 36, fastened to the sewing machine 2 and acting on the support arm 14 to take it in angular rotation about the axis of the drive shaft 15 so that, as shown in FIGS. 2 and 3, the piece of trimmings 10 or 11 to be applied to the workpiece may be disposed on the path taken by slit 34a when the cutting member 34 moves from a rest condition to a working condition.

Operation of device 1 can advantageously be controlled, together with that of the sewing machine 2 as a whole, by an electronic control unit previously loaded according to a predetermined working cycle and not shown or described as known per se and not important to the ends of the invention.

In the absence of said control unit, the operation of the different members of the device can be controlled by means of switches and the like which can be directly actuated by the user.

When at rest, the component parts of the device 1 are disposed according to one of the arrangements shown in FIGS. 2 and 3, trimmings 10, 11 being slidably engaged along the respective guides 26, 27 and 24, 25 and having their respective lower end portions interposed between the feed roller 12 and the respective pressure backing rollers 19, 20.

Referring particularly to FIG. 2, when the first piece of trimmings 10 must be applied to the workpiece, identified at 37, the first fluid-operated cylinder 30 is actuated. Thus said cylinder extends its rod **30*a* in order to orient the swinging plate 21 through the connecting lever 32 and pivot pin 21*a*, so as to bring the first backing roller 19 into abutment against the feed roller 12. Under this situation the first piece of trimmings 10 is urged against the feed roller 12 upon the action of the first backing roller 19**.

At the same time, the second fluid-operated cylinder 36 retracts its rod 36a thus keeping the support arm 1 close to the front part of the sewing machine 2. In this condition the positioning taken by the feed roller 12 and backing rollers 19 and 20 will enable the first piece of trimmings 10 to be oriented, after being engaged under the presser foot 9, so as to be correctly pulled under said presser foot together with the workpiece 37, and to be then intercepted and cut by the cutting member 34 when, at the end of the line of stitching, the cutting unit will be operated.

When, upon command of the operator, the stitching of the workpiece 37 is started, motor 16 is actuated and, through the drive shaft 15 and said toothed belt, the feed roller 12 is taken in rotation at a predetermined speed in the direction of arrow 38 as shown in FIG. 2.

The first piece of trimmings 10, urged against the feed roller 12 by the first pressure backing roller 19, is therefore pulled along by said feed roller and sent under the presser foot 9. In order to facilitate the engagement of trimmings 10 under the presser foot 9, a blowing element 39 is advantageously engaged with the swinging plate 21. Said blowing element extends below the backing roller 19 and acts so as to direct an air blow towards the lower end portion of trimmings 10 in order to suitably orient said trimmings.

Once the piece of trimmings 10 has been engaged under the presser foot 9, it is applied to the workpiece 37 while a line of stitching is being performed. During said stitching the piece of trimmings is gradually fed by the feed roller 12 which is kept in rotation by motor 16.

At the end of the application, the cutting unit 33 is operated and, according to what previously described, it will cut the piece of trimmings 10 in its portion include between the presser foot 9 and rollers 12 and 19.

When during a subsequent stitching it is necessary to apply the second trimmings 11, the device 1 will automatically take the arrangement shown in FIG. 3. Under this situation, the actuation of the first fluid-operated cylinder will bring about the retraction of the respective rod **30*a* and the swinging plate 21 will be oriented so that the second backing roller 20 may be brought in abutment against the feed roller 12. As a result, the second piece of trimmings 11 is urged against the feed roller 12 by said pressure backing roller 20 while ceasing the thrusting action of the backing roller 19 on the first trimmings 10**.

At the same time, being the second fluid-operated cylinder 36 actuated, its rod 36a will be extended. As a result, the support arm 14 by its angular rotation about the axis of the drive shaft 15 will be moved away from the front part of the sewing machine 2. Due to the displacement of the support arm 14, the feed roller 12 and the second backing roller 20 are positioned in such a manner that the second piece of trimmings 11, once it has been engaged under the presser foot 9, is ready to be applied to the workpiece and can be afterwards cut by the cutting member 34.

When the actuation of the sewing machine 2 takes place, there is the activation of motor 16 so that the feed roller 12 is taken in rotation in the reverse direction with respect to the previous one, as shown by the arrow 40 in FIG. 3. Consequently the lower end portion of the second piece of trimmings 11 will be pushed against the workpiece moving along the supporting table 4 and therefore engaged under the presser foot 9. In this case too, in order to facilitate the insertion of trimmings 11 under the presser foot 9, the presence of a second blowing element 41 is provided, which element is engaged to the swinging plate 21 and acts below the second backing roller 20 to produce an air blow adapted to orient the lower end portion of said trimmings towards the presser foot.

In the same manner as described with reference to the first piece of trimmings 10, the second piece of trimmings 11, once it has been engaged under the presser foot 9, will be applied to the workpiece during the executing of the stitching as it is gradually fed by the feed roller 12 and will then be cut by means of the cutting member 34.

The present invention attains the intended purposes.

In fact the device in question is adapted to carry out the selective feeding of two different types of trimmings without needing any manual intervention on the part of the operator for the purpose of engaging and disengaging the single pieces of trimmings to and from the members designed to feed them under the presser foot.

Advantageously the present device is also capable of carrying out the automatic cutting of the trimmings at the end of stitching.

Therefore it will be recognized that the present device eliminates all necessity of manual intervention on the part of the operator when ribbon-like trimmings must be applied to a workpiece.

Obviously, many modifications and variations may be made to the present invention, all falling within the scope of the inventive idea characterizing it.

What is claimed is:

1. A device to feed ribbon-like trimmings under the presser foot of a sewing machine, comprising:

at least a support arm fastened to the sewing machine;

a feed roller rotatably engaged with the support arm and extending before the presser foot of the sewing machine according to an axis at right angles to the feed advance direction of the workpiece;

a motor to rotate the feed roller;

at least two guides, each of them extending upwardly from the feed roller and slidably engaging a piece of trimmings to guide it towards the feed roller;

pressure means acting in abutment relationship with the feed roller to push one of said trimmings against the feed roller itself so that it may be pulled by said feed roller as a result of the rotational movement imparted thereto, wherein said pressure means comprises a first pressure backing roller and a second pressure backing roller extending parallelly to the axis of the feed roller, each of them being arranged to act on a respective ribbon-like piece of trimmings which is engaged along at least a corresponding guide and is interposed between the feed roller and the respective pressure backing roller and contacts the latter with its side facing the other pressure backing roller, said pressure backing rollers being rotatably supported by a swinging plate oscillatably engaged with the support arm and actuated by switching means to individually and selectively bring said pressure backing rollers in abutment against the feed roller thus causing the pulling of the corresponding piece of trimmings by said feed roller which, on the other hand, is designed to reverse its rotation when upon the action of said switching means there is a change in the pressure backing roller which is brought in abutment against it.

2. A device as claimed in claim 1, wherein said switching means comprises a first fluid-operated cylinder acting on a connecting lever integral to a pivot pin which rotatably crosses said support art according to an axis parallel to the axis of said feed roller and fixedly engages the swinging plate.

3. A device as claimed in claim 1, further comprising positioning means to cause each of said trimmings to maintain a predetermined orientation and positioning in the portion included between the feed roller and the presser foot when said trimmings have been arranged for application.

4. A device as claimed in claim 3, wherein said positioning means comprises at least a fluid-operated cylinder fixedly engaged to the sewing machine and acting upon the support arm to move it close to and apart from the sewing machine, said support arm being oscillatably pivoted according to an axis at right angles to the feed advance direction of the workpiece on the supporting table of the sewing machine.

5. A device as claimed in claim 4, wherein said support arm is rotatably supported by a drive shaft associated with the feed roller driving motor, said motor being fixedly engaged close to the top of the sewing machine.

6. A device as claimed in claim 1, wherein associated with each pressure backing roller is a blowing element fixedly engaged to the swinging plate, extending below the backing rollers and acting so as to send an air blow against the piece of trimmings to direct it towards the presser foot.

7. A device as claimed in claim 1, wherein said guides can be positioned along respective supporting rods extending from said swinging plate parallelly to the backing rollers.

8. A device according to claim 1, further comprising comprises a cutting unit provided with a cutting member movable from a rest position in which it is spaced apart sideways from the supporting table to a working position in which it acts before the presser foot to cut the piece of trimmings applied to the workpiece, in the portion included between the presser foot and the feed roller.

9. A device as claimed in claim 3 wherein said positioning means acts so as to cause the piece of trimmings applied to the workpiece to be disposed on the path taken by the cutting member when moving from its rest position to its working position.

10. A device as claimed in claim 8 wherein said positioning means acts so as to cause the piece of trimmings applied to the workpiece to be disposed on the path taken by the cutting member when moving from its rest position to its working position.

* * * * *